United States Patent [19]

Mimura et al.

[11] Patent Number: 4,492,745

[45] Date of Patent: Jan. 8, 1985

[54] PHOTOSENSITIVE MEMBER FOR ELECTROPHOTOGRAPHY WITH MIRROR FINISHED SUPPORT

[75] Inventors: Yoshiyuki Mimura; Takao Okada; Akitoshi Toda, all of Hachioji, Japan

[73] Assignee: Olympus Optical Company Ltd., Tokyo, Japan

[21] Appl. No.: 546,953

[22] Filed: Oct. 31, 1983

[30] Foreign Application Priority Data

Nov. 24, 1982 [JP] Japan ..... 57-205868

[51] Int. Cl.[3] ..... G03G 5/04; G03G 5/00

[52] U.S. Cl. ..... 430/67; 430/69; 430/56; 430/127; 430/55; 430/133; 430/134

[58] Field of Search ..... 430/56, 67, 69, 127, 430/133, 134

[56] References Cited

U.S. PATENT DOCUMENTS 3,488,896 1/1970 Makino et al. ..... 430/127 X
4,078,924 3/1978 Keddie et al. ..... 430/127
4,134,763 1/1979 Fujimura et al. ..... 430/69

FOREIGN PATENT DOCUMENTS 2555657 7/1976 Fed. Rep. of Germany ..... 430/127
56-150754 11/1981 Japan ..... 430/127
57-139746 8/1982 Japan ..... 430/127

*Primary Examiner*—Roland E. Martin
*Attorney, Agent, or Firm*—Louis Weinstein

[57] ABSTRACT

A photosensitive member for electrophotography basically comprises a conductive support, on the surface of which a photoconductive layer and a transparent insulating layer are sequentially laminated. The photosensitive member is adapted to be used in a process for forming an electrostatic latent image including sequential steps of a primary corona charging concurrent with imagewise exposure, a secondary corona charging and a flush irradiation. The surface of the conductive support is treated to a mirror finish, based on experimental finding that the contrast voltage of the latent image depends on the degree of surface roughness of the support.

2 Claims, 2 Drawing Figures

PHOTOSENSITIVE MEMBER FOR ELECTROPHOTOGRAPHY WITH MIRROR FINISHED SUPPORT

BACKGROUND OF THE INVENTION

The invention relates to a photosensitive member for electrophotography, and more particularly, to a photosensitive member including a conductive support, a photoconductive layer and a transparent insulating layer which are sequentially laminated one over another.

A photosensitive member for electrophotography including a conductive support, a photoconductive layer and a transparent insulating layer which are laminated one over another is already known, and is extensively used in electrophotographic copying machines. A variety of techniques are available to form an electrostatic latent image on such member. In one technique, an electrostatic latent image is formed through a series of sequential steps of primary corona charging and concurrent imagewise exposure, secondary corona charging and a flush irradiation, the latent image formed being of the opposite polarity from that of the primary corona charging.

However, when such technique is employed to form a latent image on the surface of a photosensitive member, a difference in the surface potential between a bright and a dark area of the resulting latent image or a contrast voltage is less than a theoretical value, causing the likelihood that an image having a sufficient optical density may not be obtained when the latent image is developed. It is considered that one of the causes for such difficulty would be a migration of a carrier between the conductive support and the photoconductive layer in darkness when such migration should not occur. An attenuation of charge on the photoconductive layer in darkness would be another reason.

To elucidate a mechanism which causes such migration of carrier, a study has been made by the present inventors of the surface configuration of the conductive support, paying attention to the boundary surface between the conductive support and the photoconductive layer which has been put out of consideration heretofore. It is found that the surface of the conductive support of a photoconductive member which exhibited a poor contrast voltage exhibits a significant amount of unevenness and that there is a relationship between such unevenness and the magnitude of the contrast voltage.

SUMMARY OF THE INVENTION

In view of the foregoing, it is an object of the invention to provide a photosensitive member for electrophotography which basically comprises a conductive support having a mirror finish surface on which a photoconductive layer and a transparent insulating layer are sequentially laminated and which is subject to a method of forming an electrostatic latent image through the sequential steps of a primary corona charging and concurrent imagewise exposure, a secondary corona charging and a flush irradiation.

In accordance with the invention, the surface of a conductive support is treated to a mirror finish, and a photoconductive layer and a transparent insulating layer are sequentially laminated on this surface. It is considered that this suppresses the migration of carrier between the support and the photoconductive layer in darkness, allowing an electrostatic latent image having a sufficient contrast voltage to be obtained. In this manner, a high quality image can be obtained by developing the latent image.

DESCRIPTION OF PREFERRED EMBODIMENT

Figure 1:
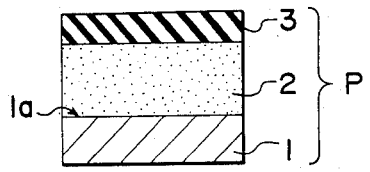
FIG. 1 is a schematic section of a photosensitive member for electrophotography according to one embodiment of the invention.
Figure 2A:
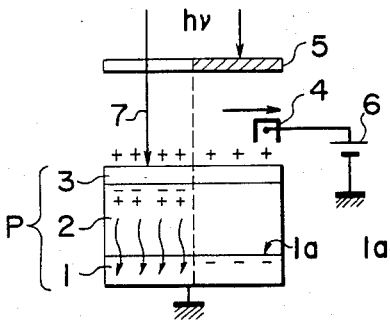
FIGS. 2(*a*) to (*e*) are schematic sections, illustrating sequential steps which are utilized when forming an electrostatic image on the photosensitive member shown in FIG. 1.
Figure 2B:
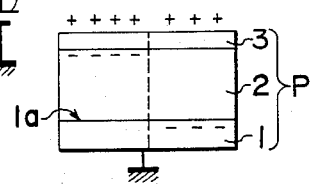
Figure 2C:
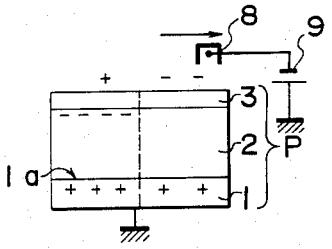
Figure 2D:
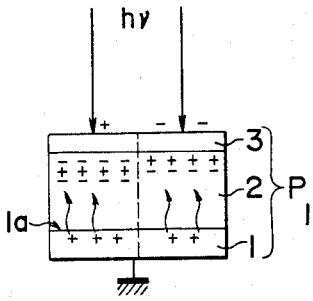
Figure 2E:
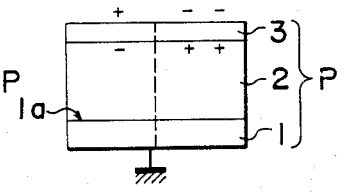

Referring to FIG. 1, there is shown a photosensitive member for electrophotography according to one embodiment of the invention. The photosensitive member P includes a conductive support 1, the surface 1*a* of which is treated to a mirror finish, a photoconductive layer 2 and a transparent insulating layer 3 are sequentially deposited on top of the surface 1*a*.

The conductive support 1 is formed by a variety of metals including aluminium (Al), nickel (Ni), molybdenum (Mo), gold (Au), silver (Ag), platinum (Pt), zinc (Zn), niobium (Nb), tantalum (Ta), vanadium (V), titanium (Ti), tellurium (Te), lead (Pb), iron (Fe), irridium (Ir), stainless steel or the like or alloys thereof, or glasses, ceramics or synthetic resin films which are treated to be conductive with ITO (indium tin oxide). The support 1 may have any desired configuration depending on the type of electrophotographic copying machine in which it is used, including a drum, a belt or a flat sheet. The surface of the support 1 is treated to a mirror finish by a known technique such as a diamond cutting.

The photoconductive layer 2 is formed by inorganic photoconductive materials including cadmium sulfide (CdS), cadmium zinc sulfide (ZnCdS), zinc monoxide (ZnO), selenium (Se), selenium tellurium (Se-Te), selenium arsenic (Se-As), and organic photoconductive materials including polyvinyl carbazole (PVK), trinitrofluorenone (TNF).

The transparent insulating layer 3 is formed by forming a film of polyethylene terephthalate, Teflon, polypropylene, polyvinyl fluoride, polyamide, polyester or the like having an increased resistivity (equal to or greater than $10^{14}$ Ωcm), a vapor deposition of paraxylylene, or the application of thermoplastic resins such as a copolymer resin or vinyl chloride and vinyl acetate, methacrylic resin, polyester resin, polyvinyl butyral resin, polystyrene resin, vinylidene chloride resin or the like or thermosetting resins such as epoxy resin, alkyd resin, acryl resin, urethane resin, silicone resin or the like.

An electrostatic latent image can be formed on the photosensitive member P which is formed in the manner mentioned above, by utilizing the sequential steps illustrated in FIGS. 2(*a*) to (*e*).

Initially, a primary corona charging takes place simultaneously with imagewise exposure, as indicated in FIG. 2(*a*). Assuming that the photoconductive layer 2 of the photosensitive member P is of p-type, a high voltage is applied to a corona charger 4 from a source of positive d.c. high voltage 6 to charge the surface of the insulating layer 3 uniformly to the positive polarity while simultaneously irradiating it with light hν to effect the exposure of light image 7. Pairs of positive and negative charges are developed within the photoconductive layer 2 in a portion corresponding to a bright area of the light image where the light hν is incident, and the positive charge passes to the ground through the conductive support 1. Accordingly, the negative charge which is of the opposite polarity from and in an amount commensurate to the charge produced by the primary charging will be trapped on the surface of the photoconductive layer 2 which is adjacent to the backside of the insulating layer 3, as shown in FIG. 2(*b*). On the other hand, in a dark area of the light image where the incidence of the light hν does not occur, no pair of positive and negative charge is developed within the photoconductive layer 2, which therefore maintains its high resistivity condition. Accordingly, a negative charge which is commensurate to the amount of charge produced on the surface of the insulating layer 3 as a result of the primary charging will be induced on the surface of the conductive support 1.

In a conventional photosensitive member used for the electrophotography, a boundary surface between the conductive support and the photoconductive layer has been uneven, resulting in a high tendency toward the migration of carrier therebetween. However, with the photosensitive member P of the invention in which the surface of the conductive support 1 is treated to a mirror finish, it is considered that such tendency is drastically reduced.

Subsequently, a secondary corona charging takes place as indicated in FIG. 2(*c*). Thus, a negative high voltage is applied to a corona charger 8 from a source of negative d.c. high voltage 9, applying a negative charge uniformly to the surface of the insulating layer 3. In a bright area of the light image, the negative charge is trapped within the photoconductive layer 2, as mentioned previously, and hence the surface of the insulating layer 3 is less subject to being charged to the negative polarity, as compared with a dark area of the light image. However, the surface potential of the bright area will be substantially equal to that of the dark area. A positive charge is induced in the conductive support 1 in an amount which corresponds to a difference of positive and negative charge on the opposite sides of the insulating layer 3.

With the photosensitive member P of the invention, the mirror finish of the surface of the conductive support 1 reduces the likelihood that the carrier may leak between the support 1 and the photoconductive layer 2 under this condition.

A flush irradiation with light hν then takes place as indicated in FIG. 2(*d*). Pairs of positive and negative charges are developed within the photoconductive layer 2, and a reduction in the resistivity of the layer 2 results in the injection of positive charge into the photoconductive layer 2 from the support 1. Accordingly, as indicated in FIG. 2(*e*), all charge except the charge on the surface of the insulating layer 3 and the charge of the opposite polarity which is trapped within the photoconductive layer 2 in corresponding manner to the surface charge will disappear, thus forming an electrostatic latent image.

The mirror finish of the conductive support 1 again minimizes the likelihood of leakage of carrier occurring between the support 1 and the photoconductive layer under the condition that the latent image is formed, thus maintaining a high contrast voltage.

To illustrate the effect achieved with the photosensitive member of the invention, several examples will now be specifically described.

EXAMPLE 1

An aluminium drum having a diameter of 128 mm and a length of 204 mm is used as a conductive support, and its surface is polished with diamond polishing means to a mirror finish which corresponds to a surface roughness of 0.1 S or less. Subsequently, a selenium charge transport layer and a selenium-tellurium charge generating layer are sequentially laminated thereon by vacuum evaporation, thus forming a photoconductive layer. To effect such vacuum evaporation, a vacuum on the order of $10^{-6}$ torr is established within a vacuum evaporating unit while simultaneously heating the aluminium drum to 55° C. When the temperature of the aluminium drum becomes stabilized, a boat containing 99.99% selenium is heated to evaporate it for 170 minutes, followed by the evaporation of selenium-tellurium containing 8% of tellurium for seven minutes and thirty seconds, thus forming a photoconductive layer having a thickness of 50 μm. Finally, a transparent insulating layer having a thickness of 16 μm is formed on top of the photoconductive layer, thus obtaining a sample of photosensitive member.

EXAMPLE 2

The surface of the aluminium drum which is constructed in the same manner as described in Example 1 is initially treated to a mirror finish corresponding to a surface roughness of 0.1 S or less, followed by roughening the surface with No. 100 sandpaper. Subsequently, a photoconductive layer and a transparent insulating layer are sequentially laminated over the surface in the same manner as mentioned in Example 1 above, thus forming a control 1 of photosensitive member.

EXAMPLE 3

A control 2 of photosensitive member is produced by a similar procedure as mentioned in Example 2 except that the drum surface is roughened with No. 240 sandpaper.

EXAMPLE 4

A control 3 of photosensitive member is formed by a procedure similar to that mentioned in Example 1 except that the drum surface is roughened with No. 600 sandpaper.

A surface roughness meter of needle probe type is used to determine the surface roughness of the aluminium drum for each of the sample and the controls before the evaporation takes place. The results of determination are indicated below:

| | Maximum Height (Hmax) |
|---|---|
| Example 1 | 0.1 S or less |
| Example 2 | 1.5 S |
| Example 3 | 2.5 S |
| Example 4 | 3.5 S |

Experiments have been conducted to form an electrostatic latent image on each of the examples and the controls by using a process in which a primary charging takes place by a Corotron charger utilizing a wire voltage of +6 kV while simultaneously exposing a light image from a halogen lamp and in which a secondary charging takes place by using a Scorotron charger utilizing a wire voltage of −7.5 kV and a grid voltage of −1.5 kV to effect a reverse charging, followed by a flush irradiation with a fluorescent lamp.

The resulting contrast voltages are indicated below:

| | Contrast Voltage |
|---|---|
| Example 1 | 550 V |
| Example 2 | 130 V |
| Example 3 | 120 V |
| Example 4 | 100 V |

It will be seen from the above result that the surface roughness has a great influence upon the magnitude of the contrast voltage.

Another experiment has been conducted to form an electrostatic latent image according to NP (new process) system including a primary charging, a secondary a.c. charge neutralization with concurrent imagewise exposure and a flush irradiation. It is recognized that this process produces a higher contrast voltage for a better carrier injection during the primary charging. When the process is applied to each of the described Examples, it is found that Examples 2 to 4 produce contrast voltages close to 500 V, which are satisfactory for practical purposes, while Example 1 produces a contrast voltage which is as low as the order of 120 V, in a manner contrary to the first mentioned result.

It will be apparent from the foregoing that a photosensitive member for electrophotography in which the surface of a conductive support is treated to a mirror finish yields results depending on a particular process used to form a latent image, and is most effective with the process including a primary charging concurrent with imagewise exposure, a secondary corona charging and a flush irradiation.

It is found that the surface roughness of the conductive support should be equal to or less than 1.5 S since otherwise a high contrast voltage cannot be obtained.

What is claimed is:

1. a photosensitive member for electrophotography for use in a process of forming an electrostatic latent image by sequential steps of a primary corona charging concurrent with imagewise exposure, a secondary corona charging and a flush irradiation; comprising:

a conductive support having its surface treated to a mirror finish, the surface roughness of said surface being no greater than 0.1 S;

a photoconductive layer laminated on the surface of the conductive support; and a transparent insulating layer laminated on the photoconductive layer.

2. A method for producing a photosensitive member for use in electrophotographic copiers and the like on which member an enhanced latent image is formed, said method comprising the steps of:

providing a conductive member and finishing one major surface of said conductive member to provide a mirror-finish surface having a surface roughness no greater than 0.1 S;

forming a photoconductive layer upon said mirror finish surface; and forming an insulating layer upon said photoconductive layer.

* * * * *